United States Patent [19]

Cole

[11] 3,968,337

[45] July 6, 1976

[54] DOOR-ACTUATED ALARM SWITCH

[76] Inventor: Donald G. Cole, 1528 E. Broadmoor St., Springfield, Mo. 65804

[22] Filed: Apr. 30, 1975

[21] Appl. No.: 573,321

Related U.S. Application Data

[63] Continuation-in-part of Ser. No. 492,169, July 26, 1974, abandoned, which is a continuation-in-part of Ser. No. 402,028, Oct. 1, 1973, abandoned, which is a continuation-in-part of Ser. No. 267,565, June 29, 1972, abandoned.

[52] U.S. Cl. ..... 200/61.62; 200/61.41; 200/61.78; 200/61.79; 200/61.81; 200/318; 200/327; 200/332

[51] Int. Cl.[2] ..... H01H 3/16; H01H 3/20

[58] Field of Search ..... 200/61.41, 61.42–61.44, 200/61.62–61.84, 153 T, 318, 322–325, 327, 329, 332; 340/274; 116/87

[56] References Cited

UNITED STATES PATENTS

| | | | |
|---|---|---|---|
| 480,340 | 8/1892 | Neal et al. | 200/61.78 |
| 908,918 | 1/1909 | Wells | 200/61.62 |
| 1,374,684 | 4/1921 | Rieck | 116/87 |
| 1,580,782 | 4/1926 | Gross | 200/61.41 X |
| 1,595,520 | 8/1926 | Larson | 200/61.78 |
| 2,265,899 | 12/1941 | Fine | 200/61.62 X |
| 2,500,335 | 3/1950 | Barnwell | 200/61.79 |
| 2,516,163 | 7/1950 | Vaughan | 200/332 X |
| 3,264,444 | 8/1966 | Krauss et al. | 200/332 |
| 3,541,276 | 11/1970 | Lea | 200/61.62 |

*Primary Examiner*—James R. Scott
*Attorney, Agent, or Firm*—Koenig, Senniger, Powers and Leavitt

[57] ABSTRACT

An alarm switch adapted to be mounted on the wall above a door on the side of the wall toward which the door swings open, having an electrically conductive arm adapted to be set in a position for actuation by the door, when the door swings, to swing inwardly and then upwardly into engagement with a terminal of the switch to complete an alarm circuit. The arm has a finger at its free end adapted to be set in a downwardly extending position for engagement by the door and a raised position clear of the door for deactivating the switch.

20 Claims, 20 Drawing Figures

FIG.6
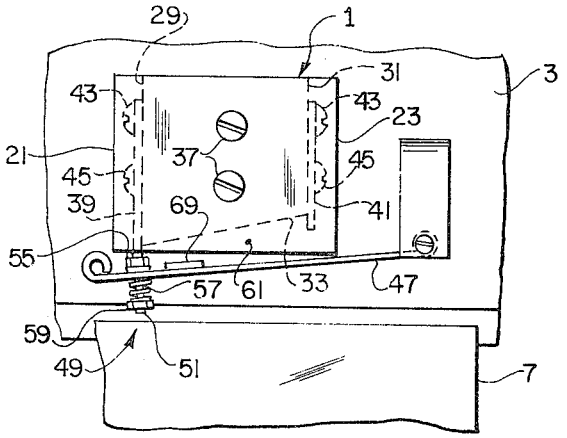
FIG.7
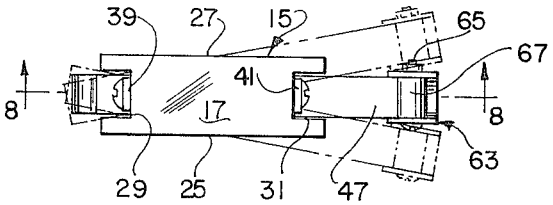
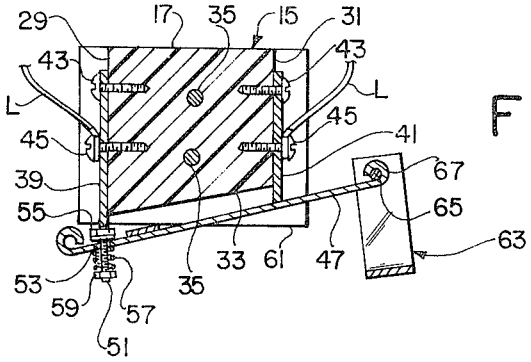
FIG.8
FIG.9
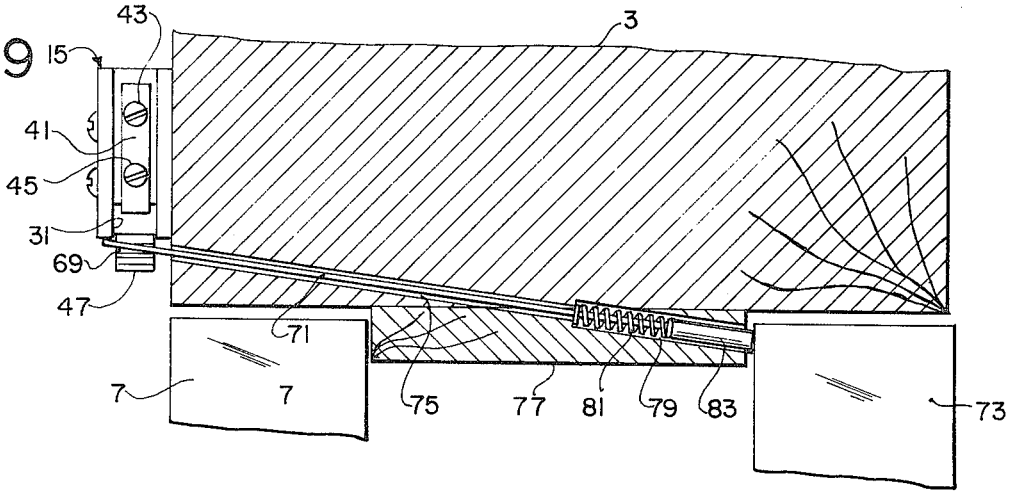

DOOR-ACTUATED ALARM SWITCH

CROSS-REFERENCE TO RELATED APPLICATION

This application is a continuation-in-part of my abandoned application Ser. No. 492,169, filed July 26, 1974, which in turn is a continuation-in-part of my abandoned application Ser. No. 402,028, filed Oct. 1, 1973, which in turn is a continuation-in-part of my abandoned application Ser. No. 267,565, filed June 29, 1972.

BACKGROUND OF THE INVENTION

This invention is in the field of electrical switches, and, more particularly, relates to a door-actuated alarm switch.

SUMMARY OF THE INVENTION

Among the several objects of the invention may be noted the provision of a simple, inexpensive burglar alarm switch adapted for actuation by a door on opening of the door to complete an alarm circuit, thereby to energize an alarm signal such as an electric lamp or audio signal (e.g., a bell or siren); the provision of such a switch adapted to be mounted on the wall above a door on the inside of the wall toward which the door swings open; the provision of such a switch which is readily set to detect the opening of the door, and readily deactivated for opening of the door without signalling an alarm; and the provision of such a switch useful in conjunction either with a single door or with a double-door arrangement, adapted, in the latter case, to signal the opening of the outer door of the double-door arrangement.

In general, an alarm switch of this invention comprises a body of electrical insulation material adapted to be mounted on a wall above a door opening on the side of the wall toward which the door in the door opening swings open. The body carries first and second electrical terminals extending down at the bottom of the body and adapted for attachment of electrical lines thereto for connection of the switch in an alarm circuit, with the lower ends of said terminals spaced endwise of said body. The switch further comprises an electrically conductive switch arm and means mounting the arm at the lower end of the first terminal for up and down swinging movement and also for swinging movement about a generally vertical axis relative to the body with the arm in electrically conductive relation with the first terminal. The arm is swingable upwardly generally in the plane of the terminals to a raised circuit-closing position engaging the lower end of the second terminal. Spring means is provided biasing the arm to swing upwardly, and the arm is swingable downwardly against the bias of the spring means and laterally away from its said raised circuit-closing position to a position for actuation by the door angled toward the door. Stop means is provided extending down from the bottom of the body engageable by the arm when swung to its said angled position to hold it down against the bias of the spring means. Means is provided at the free end of the arm engageable by the door on opening of the door when the arm is in its said angled position for swinging the arm out from under said stop means, whereupon the arm swings up into engagement with said second terminal.

Other objects and features will be in part apparent and in part pointed out hereinafter.

BRIEF DESCRIPTION OF THE DRAWINGS

FIG. 6 is a view similar to FIG. 2 but showing the switch deactivated;

FIG. 7 is a plan of the switch;

FIG. 8 is a vertical longitudinal section of the switch on line 8—8 of FIG. 7;

FIG. 9 is a view showing use of the switch in conjunction with a double-door arrangement;

Corresponding reference characters indicate corresponding parts throughout the several views of the drawings.

DESCRIPTION OF THE PREFERRED EMBODIMENT

Figure 1:
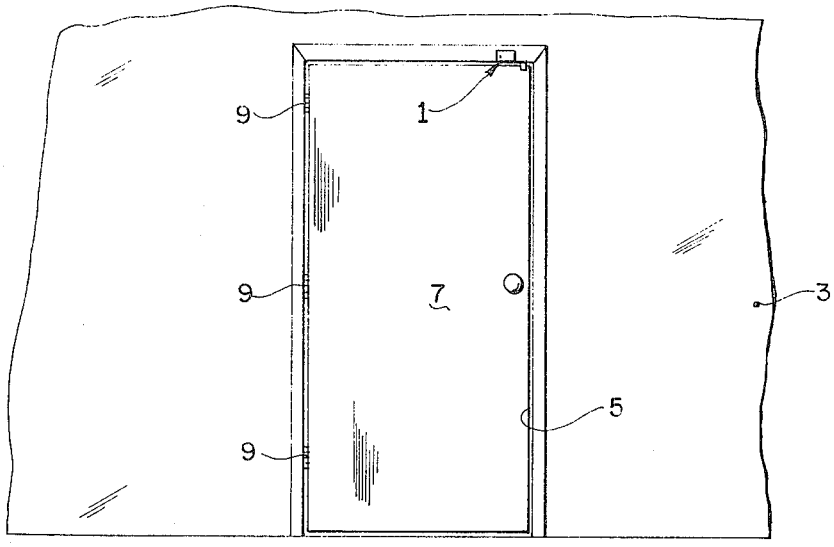
FIG. 1 is a view showing a switch of this invention mounted on the wall above a door (i.e., mounted on the trim of the door frame at the top of the door)
Figure 2:
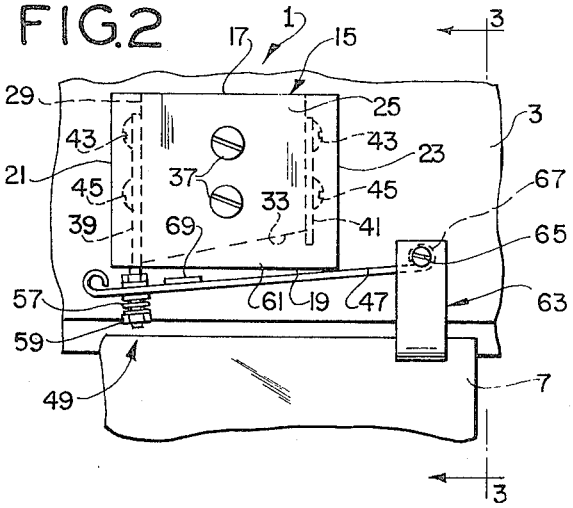
FIG. 2 is a view in elevation of the switch on a larger scale than in FIG. 1, showing the switch set for actuation by the door.
Figure 3:
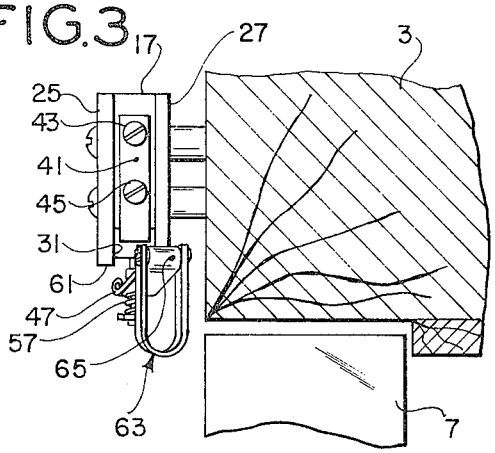
FIG. 3 is a vertical section on line 3—3 of FIG. 2.

Referring first to FIG. 1 of the drawings, there is indicated at 1 an alarm switch of this invention mounted in position on a wall 3 above a door opening 5 in the wall. At 7 is indicated a door in the door opening 5, hinged as indicated at 9 at the left in the door opening to switch open toward the viewer. As shown in FIG. 1, the switch 1 is mounted on the trim 11 of the door frame 13 at the top of the door, this trim being in effect a part of the wall, on the side of the wall 3 (the inside) toward which the door swings open.

Next referring more particularly to FIGS. 2, 3, 7 and 8, the switch 1 is shown to comprise a body 15 of any suitable electrical insulation material, e.g., a suitable synthetic plastic material, of rectangular form, with the top of the body indicated at 17, its bottom at 19, its ends at 21 and 23 and its side faces at 25 and 27. The body has a vertical groove 29 in its left end 21, and a vertical groove 31 in its right end 23, each of these grooves extending from top to bottom of the body. It also has a groove 33 in its bottom inclined upwardly from its left end 21 to its right end 23. At 35 are indicated holes in the body for receiving screws 37 for mounting it on the wall.

At 39 is indicated a first electrical terminal of the switch carried by the body 15 in the groove 29 at its left end, and at 41 is indicated a second electrical terminal of the switch carried by the body 1 in the groove 31 at its right end. These terminals are adapted for attachment thereto of electrical lines L (see FIG. 8) for connection of the switch in an alarm circuit. They extend down at the bottom of the body, their lower ends being spaced endwise of the body. Each comprises a metal strip (e.g., brass) secured to the body by upper and lower screws 43 and 45, the lower screws for example constituting means for attachment of lines L (see FIG. 8).

At 47 is indicated an electrically conductive switch arm, constituted by a strip of metal such as brass, mounted at its left end by means such as generally indicated at 49 at the lower end of the terminal 39 for up and down swinging movement and also for swinging movement about a generally vertical axis relative to the body with the arm in electrically conductive relation with the terminal 39. More particularly, the means 49 comprises a lower threaded pivot pin portion 51 of the terminal 39 extending down below the bottom 19 of the body 1. The arm 47 has an opening at 53 receiving the pin with a sufficiently loose fit to enable up and down swinging of the arm, as well as swinging movement about the vertical axis of the pivot pin 51. A nut 55 is threaded up on pin 51 to its upper end and serves as an abutment above and engageable by the arm 47, and the arm is held up against this nut by a coil spring 57 on the pin reacting upwardly against the bottom of the arm from an abutment 59 constituted by another nut threaded on the lower end of the pin. This coil spring constitutes spring means biasing the arm 47 to swing upwardly about a transverse horizontal axis through the pin, the arm being swingable upwardly generally in the groove 33 in the plane of the terminals 39 and 41 and between the bottom portions or flanges 61 of the body 1 at opposite sides of the groove 33 to a raised circuit-closing position engaging the lower end of the terminal 41 (see FIGS. 4, 5 and 8). The arm 47 is swingable downwardly against the bias of spring 57 and laterally away from its said raised circuit-closing position to a position angled toward one side or the other of the body 1 (as shown in phantom in FIG. 7). In either angled position, it extends underneath the respective downwardly extending flange 61, the arm engaging the latter, which functions as a stop means to hold the arm down against the bias of the spring 57.

Figure 4:
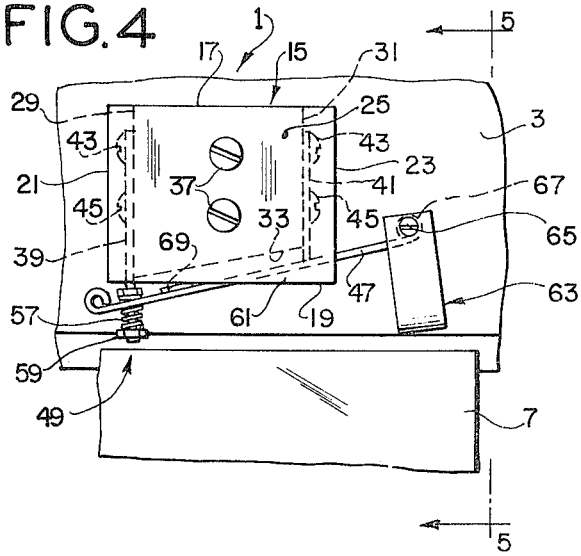
FIG. 4 is a view similar to FIG. 2 but showing the switch after actuation by the door.

Means indicated generally at 63 is provided at the free end of the arm 47 engageable by the door on opening of the door when the arm is in angled position inclined toward the door for swinging the arm out from under that flange 61 with which the arm is in engagement, whereupon the arm swings up into engagement with the terminal 41 (see FIGS. 4 and 8). This means comprises a finger constituted, as shown, by a U-shaped metal strip straddling the end of the arm and pivoted by means of a pin 65 extending through an eye 67 formed at the end of the arm for swinging movement relative to the arm between a downwardly extending position for engagement by the door (FIGS. 1–5 and 8) and a raised position (FIG. 6) clear of the door.

Figure 5:
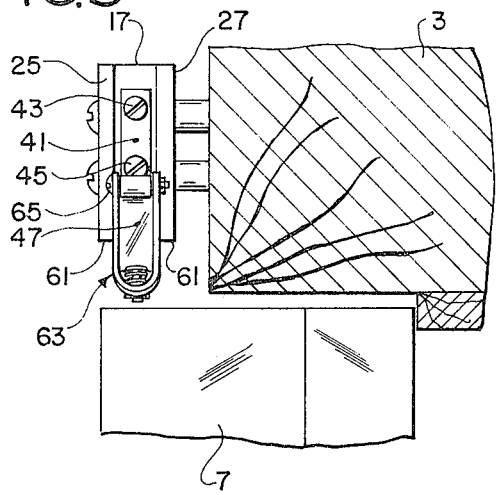
FIG. 5 is a vertical section on line 5—5 of FIG. 4.

The switch 1 is mounted as illustrated in FIGS. 1–6 on the wall 3 just above the door 7 in such position that with arm 47 in its down position angled in the direction toward the door (and held down by the flange or stop means 61 of body 1 toward the door) and with finger 63 extending down at the free end of the arm (as in FIGS. 1–3), the finger is in position for engagement of its lower end by the door on opening of the door. When the door opens, it engages the lower end of the finger 63 and swings the arm 47 out from under the stated flange 61 to the point where the arm clears this flange, whereupon the arm is swung up in the groove 61 by spring 57 into engagement with the lower end of terminal 41, as illustrated in FIGS. 4, 5 and 8. This completes the alarm circuit to energize the alarm (which may be a visual or audible alarm) for signalling the opening of the door. When the arm swings up, the arm and the finger are clear of the door (see FIGS. 4 and 5) so that the arm will not be broken off. To deactivate the switch, it is simply necessary, with the arm 47 down as in FIG. 6, to swing up the finger 63 to be clear of the door, and, with the arm down and the finger up, the switch is open and out of operation by the door.

The arm 47 has a pad 69 on its upper side adjacent the pivot pin 51 used when the switch is utilized in conjunction with a double-door arrangement as shown in FIG. 9. Here, an operating rod 71 controlled by the outer door 73 has its inner end interposed between the pad and the flanges 61 to hold the arm 47 down. The rod extends through an inclined opening 75 provided in the wall above the door and in the top door stop 77 for the two doors. The opening is counterbored at its outer end as indicated at 79, and a coil compression spring 81 is provided in the counterbore reacting from the inner end of the counterbore against a head 83 on the outer end of the rod to bias the rod outwardly into engagement of the outer end of the head 83 with the outer door. Thus, when the outer door is opened, the rod springs out, and arm 47 is released to spring up into its circuit-closing position.

Figure 10:
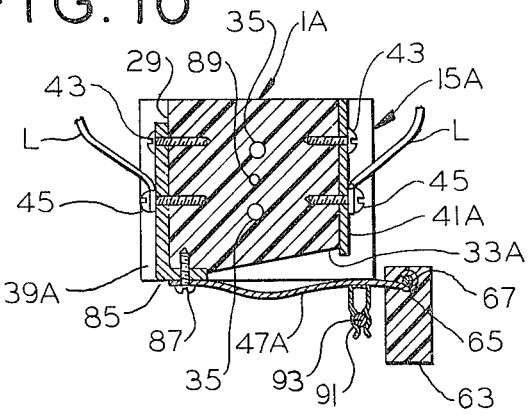
FIG. 10 is a view in elevation of an alternate embodiment of the switch showing the switch set for actuation.

An alternate embodiment of the present invention is shown in FIG. 10, comprising a switch 1A similar to switch 1 with the exception that an electrically conductive switch arm 47A made of flexible resilient spring material such as brass is used.

A first electrical terminal 39A is carried by body 15A in groove 29 at its left end. Terminal 39A has a lower portion 85 extending horizontally along the bottom of body 15A towards the center of the switch. The left end of arm 47A is suitably connected to the bottom of the lower portion 85 of terminal 39A as by means of a screw 87. It is to be understood that the connection is sufficiently loose to permit swinging movement of arm 47A about a generally vertical axis relative to the body with the arm in electrically conductive relationship with terminal 39A.

Arm 47A is shaped so that, when in vertical alignment with groove 33A, it is biased (due to its inherent spring action) to swing upwardly about a transverse horizontal axis extending through screw 87 to a raised circuit-closing position engaging the lower end of terminal 41A. As in the previous embodiment, arm 47A is swingable downwardly against the bias of the spring action and laterally away from its raised circuit-closing position to an actuation position angled toward one side or the other of body 15A. It is noted that terminal 39A is of much greater cross section than arm 47A thereby preventing any flexing of the lower portion of terminal 39A when arm 47A moves from an actuation position to the circuit-closing position or vice versa.

The operation of the alternate embodiment in response to the opening of a door is identical to that previously described in regard to the first embodiment.

A suitable housing (not shown) may be provided for the switch, secured thereto by a screw (not shown) received in a hole 89 in the body 15A.

Figure 11:
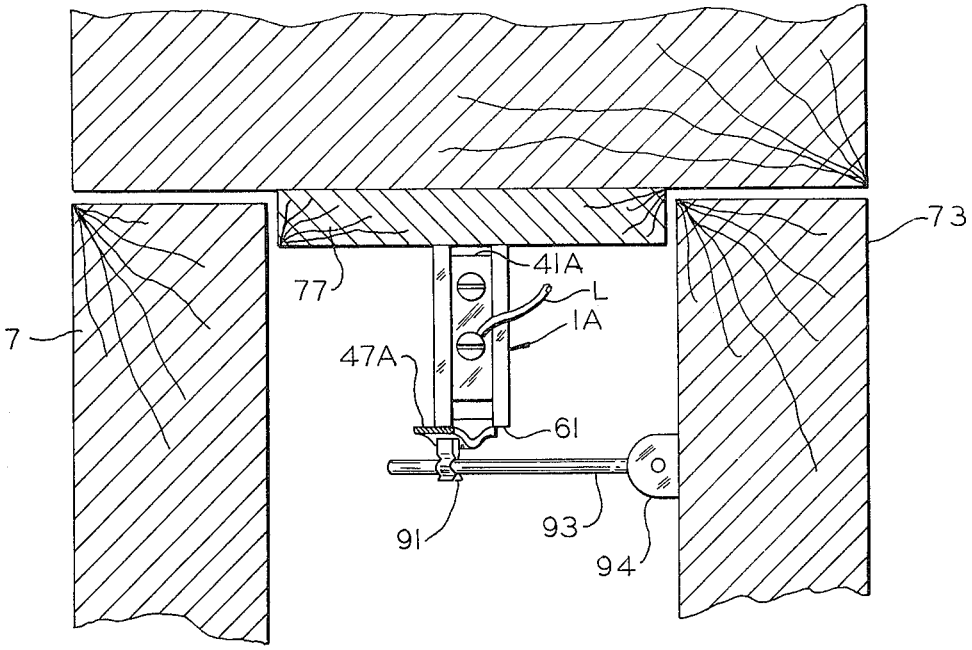
FIG. 11 is a view showing use of the alternate embodiment of the switch in conjunction with a double-door arrangement.

The arm 47A has a spring clip 91 mounted on its bottom near its free end used when the switch is utilized in conjunction with a double-door arrangement as shown in FIG. 11. Here, an operating rod 93 having its right end suitably connected by a mounting means 94 to outer door 73 has its left end releasably gripped by the spring clip with arm 47A in an actuation position angled away from the outer door, switch 1A being suitably mounted underneath the door stop 77 for the two doors, the end of the rod extending generally laterally of the arm. The mounting means 94 allows 180° rotation of the left end of the rod about a horizontal axis through the mounting means and limited rotation of the left end of the rod about a vertical axis through the mounting means. When the outer door is opened rod 93 pulls the free end of arm 47A to the right until arm 47A is in vertical registration with the groove 33A at which time the switch 1A closes. In other words, movement of rod 93 in the general direction of its longitudinal axis by the opening of the outer door causes the arm to move from a position for actuation to the circuit-closing position. Continued opening at the door causes the left end of rod 93 to be pulled free of the grip of spring clip 91, the free end of arm 47A being restrained from horizontal rotation by right-hand flange 61, whereupon rod 93 falls to a rest position adjacent the outer door.

Figure 12:
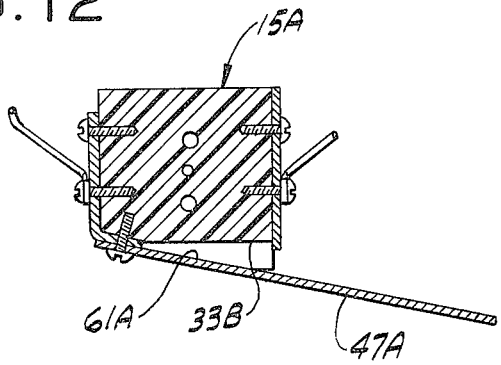
FIG. 12 is a view similar to FIG. 10 of a modification.

FIG. 12 shows a modification of the FIG. 10 embodiment in which the groove in the bottom of the body of the switch has its inside surface 33B horizontal, and the bottom edges 61A of its flanges which define the groove inclined downwardly in the direction toward the free end of the arm 47A.

Figure 13:
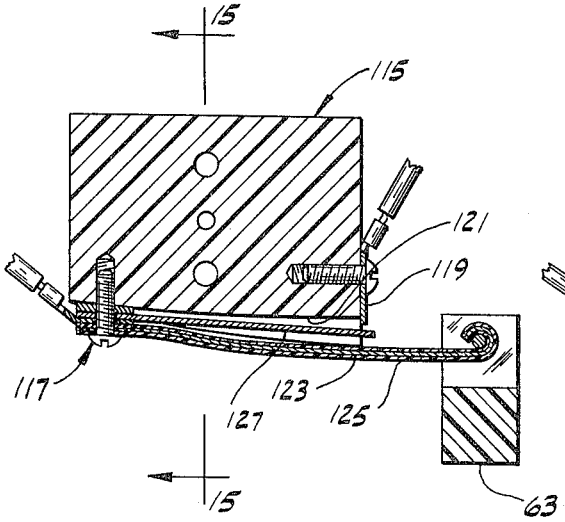
FIG. 13 is a view similar to FIG. 10 showing another embodiment.
Figure 14:
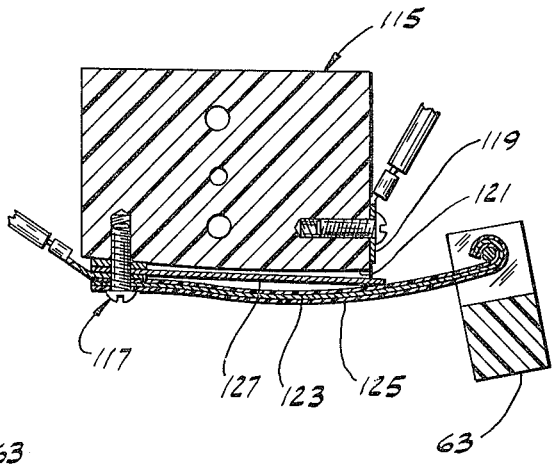
FIG. 14 is a view similar to FIG. 13 showing the switch closed.
Figure 15:
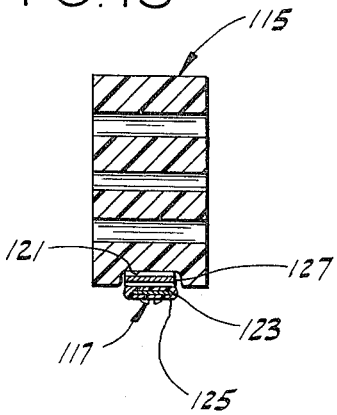
FIG. 15 is a section on line 15—15 of FIG 13.
Figure 16:
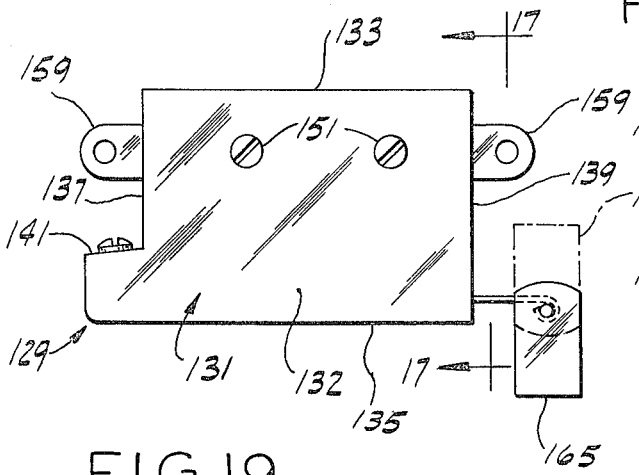
FIG. 16 is a front elevation of another embodiment.
Figure 17:
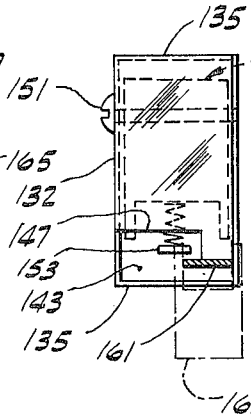
FIG. 17 is a view in section on line 17—17 of FIG. 16.
Figure 18:
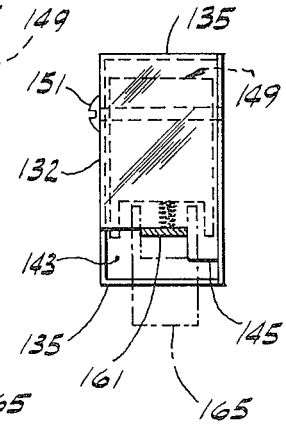
FIG. 18 is a view similar to FIG. 17 showing a moved position of parts.
Figure 19:
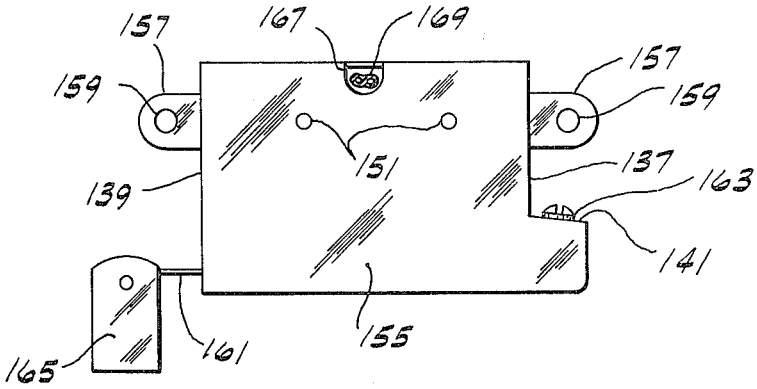
FIG. 19 is a rear elevation of the FIG. 16 unit.
Figure 20:
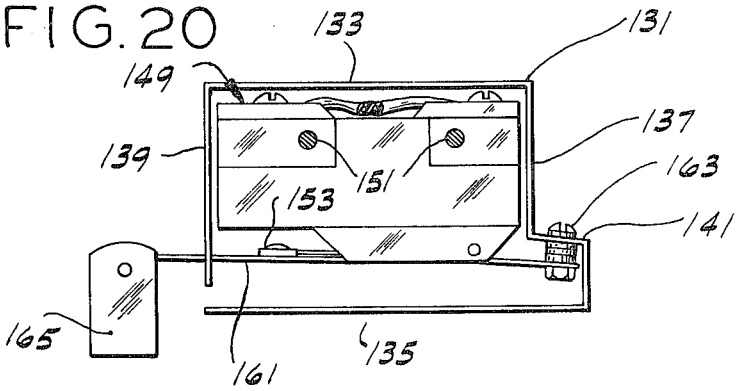
FIG. 20 is a view similar to FIG. 19 with a rear cover removed.

FIGS. 13–15 show another embodiment having a body 115 similar to 15A having first and second terminals 117 and 119 functionally corresponding to 39A and 41A. The bottom groove of the body 115 corresponding to groove 33A is designated 121. At 123 is indicated a spring arm having an insulation cover 125. This arm is mounted at the lower end of the first terminal 117 (shown as a screw) for up and down swinging movement and also for swinging movement about a generally vertical axis relative to the body 115. It carries finger 63 at its free end. An electrically conductive spring blade 127 is mounted at the lower end of terminal 117 and extends above arm 123. Blade 127 is normally out of contact with terminal 119 (being so inherently biased) as shown in FIG. 13, and is moved into contact with terminal 119 by arm 123 when the latter swings up in the groove 123 to its raised circuit-closing position of FIG. 14. Thus, the embodiment of FIGS. 13–15 functions similarly to the FIG. 10 embodiment except that the circuit is completed through the blade 127 instead of through the arm.

FIGS. 16–20 show another embodiment employing a spring arm similar to that shown in FIGS. 13 and 14 for actuating a microswitch. This embodiment comprises a support generally designated 129 constituted by a two-part case. The case comprises a front part 131 having a front wall 132, top and bottom walls 133 and 135, and end walls 137 and 139. The end wall 137 has an offset 141 toward the bottom. The end wall 139 has an opening 143 at the bottom, the top of this opening being stepped to provide a lower edge portion 145 toward the rear constituting a stop means for the spring arm of the unit, as will appear, and an upper edge portion 147. A switch 149, e.g., a conventional microswitch, is mounted in the front part 131 of the case as by means of screws 151. The switch is positioned above the bottom 135 of the front part of the case and has operating means 153, shown as a pivoted arm, at the bottom thereof. The case further comprises a rear cover 155 held on by the screws, and having ears 157 with holes 159 thereon for screws to attach the case in position above a door. An arm 161 constituted by a spring blade extends underneath the switch 149, being mounted at one end thereof on the offset 141 by means of a pin 163 for up and down swinging movement toward and away from the switch operating means 153 and also for swinging movement relative to the case about the vertical axis of the pin. The arm carries finger 165 (like finger 63) at its free end. It is swingable upwardly to a raised position (see FIG. 18) engaging the switch operating means 153 to close the switch and is inherently biased to swing upwardly. It is swingable downwardly against the bias and laterally away from its raised switch-closing position to the angled position of FIG. 17 for actuation by the door. In the latter position, arm 161 engages the stop means 145 to hold it down against its bias to keep it from swinging up and actuating the switch. When it is swung off the stop means, it springs up, engages the switch operating arm 153 and swings it upward to close the switch. Thus the embodiment of FIGS. 16–20 functions similarly to the previous embodiments except that the circuit is completed via the switch 149. The rear cover has an opening 167 for the electrical conductor 169 for the switch.

It is to be understood that two or more of the switches may advantageously be used in ganged relationship, the arms of the switches being connected by a suitable linkage so that the ganged switches are simultaneously actuated by the opening of a single door whereby respective alarm circuits are energized.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An alarm switch for actuation by a door comprising:

a body of electrical insulation material adapted to be mounted on a wall above a door opening on the side of the wall toward which the door in the door opening swings open, first and second electrical terminals carried by the body extending down at the bottom of the body and adapted for attachment of electrical lines thereto for connection of the switch in an alarm circuit, the lower ends of said terminals being spaced endwise of said body, an electrically conductive switch arm, means mounting the arm at the lower end of the first terminal for up and down swinging movement and also for swinging movement about a generally vertical axis relative to the body with said arm in electrically conductive relation with the first terminal, said arm being swingable upwardly generally in the plane of the terminals to a raised circuit-closing position engaging the lower end of the second terminal, and being biased to swing upwardly, said arm being swingable downwardly against the bias and laterally away from its said raised circuit-closing position to a position for actuation by the door angled toward the door, stop means extending down from the bottom of said body engageable by the arm when swung to its said angled position to hold it down against said bias, and means at the free end of the arm engageable by the door on opening of the door when the arm is in its said angled position for swinging the arm out from under said stop means, whereupon the arm swings up into engagement with said second terminal.

2. An alarm switch as set forth in claim 1 wherein said arm has a finger at its free end movable relative to the arm between a downwardly extending position for engagement by the door and a raised position clear of the door.

3. An alarm switch as set forth in claim 2 wherein the finger is pivoted at the end of the arm.

4. An alarm switch as set forth in claim 1 having stop means at both sides of the body enabling setting the arm angled out at one side or the other of the body.

5. An alarm switch as set forth in claim 1 wherein the first terminal has a lower pivot portion extending down below the bottom of the body including a pin, said arm having an opening receiving the pin with a loose fit enabling up and down swinging of the arm.

6. An alarm switch as set forth in claim 5 wherein said body has vertical grooves in its ends and a groove in its bottom inclined upwardly from one end toward the other, the first terminal comprising a metal strip secured in the groove at said one end and the second terminal comprising a metal strip secured in the groove at the other end of the body, portions of the body on opposite sides of the bottom groove constituting said stop means for the arm.

7. An alarm switch as set forth in claim 6 wherein the strips are secured to the body by screws, certain of said screws constituting means for attachment of said electrical lines.

8. An alarm switch as set forth in claim 6 wherein said pivot portion has an abutment above and engageable by said arm, and spring means biasing said arm against said abutment.

9. An alarm switch as set forth in claim 8 wherein said spring means comprises a coil spring on said pivot portion reacting from an abutment at the lower end of the pivot means against the arm.

10. An alarm switch as set forth in claim 6 wherein the arm has a pad on its top for holding the arm down via an operating rod extending laterally of the arm between said stop means and the pad.

11. An alarm switch for actuation by a door comprising:

a body of electrical insulation material adapted to be mounted above a door opening;

first and second electrical terminals carried by the body extending down at the bottom of the body and adapted for attachment of electrical lines thereto for connection of the switch in an alarm circuit, the lower ends of said terminals being spaced endwise of said body;

an electrically conductive switch arm, means mounting the arm at the lower end of the first terminal for up and down swinging movement and also for swinging movement about a generally vertical axis relative to the body with said arm in electrically conductive relation with the first terminal, said arm being swingable upwardly generally in the plane of the terminals to a raised circuit-closing position engaging the lower end of the second terminal, and being biased to swing upwardly;

said arm being swingable downwardly against the bias and laterally away from its said raised circuit-closing position to a position for actuation by the door;

stop means extending down from the bottom of said body engageable by the arm when swung to its said angled position to hold it down against said bias;

and means at the free end of the arm operable by the door on opening of the door when the arm is in its said angled position for swinging the arm from under said stop means, whereupon the arm swings up into engagement with said second terminal.

12. An alarm switch as set forth in claim 11 wherein said means comprises means for releasably gripping an operating rod extending from the door, said rod being adapted for movement in the general direction of its longitudinal axis to move said arm from a position for actuation to the circuit-closing position and to pull free of said gripping means.

13. An alarm switch as set forth in claim 12 wherein said gripping means comprises a spring clip.

14. An alarm switch as set forth in claim 11 wherein said arm is made of flexible resilient electrically conductive spring material formed to be biased to swing upwardly to said raised circuit-closing position.

15. An alarm switch for actuation by a door comprising:

a body of electrical insulating material adapted to be mounted adjacent the door when the door is closed; first and second spaced-apart electrical terminal means carried by the body extending from the body and adapted for attachment of electrical lines thereto for connection of the switch in an alarm circuit;

an electrically conductive switch arm means;

means mounting the arm means at the extending end of the first terminal means with said arm means in electrically conductive relation with the first terminal means, said arm means being swingable between a circuit-closing position engaging the extending end of the second terminal means and a position for actuation by the door wherein the circuit is open; and means at the free end of the arm means for releasably gripping an operating rod extending from the door, said rod being adapted for movement in the general direction of its longitudinal axis to move said arm from a position for actuation to the circuit-closing position and to pull free of said gripping means.

16. An alarm switch for actuation by a door comprising:

a body of electrical insulation material adapted to be mounted above a door opening;

first and second electrical terminals carried by the body extending down at the bottom of the body and adapted for attachment of electrical lines thereto for connection of the switch in an alarm circuit, the lower ends of said terminals being spaced endwise of said body;

an arm, mounted at the lower end of the first terminal for up and down swinging movement and also for swinging movement about a generally vertical axis relative to the body, said arm being swingable upwardly generally in the plane of the terminals to a raised position for closing a circuit between said terminals, and being biased to swing upwardly;

said arm being swingable downwardly against the bias and laterally away from its said raised circuit-closing position to a position for actuation by the door;

stop means extending down from the bottom of said body engageable by the arm when swung to its said angled position to hold it down against said bias;

and means at the free end of the arm operable by the door on opening of the door when the arm is in its said angled position for swinging the arm from under said stop means, whereupon the arm swings up to its said raised circuit-closing position.

17. An alarm switch as set forth in claim 16 wherein said means comprised means for releasably gripping an operating rod extending from the door, said rod being adapted for movement in the general direction of its longitudinal axis to move said arm from a position for actuation to the circuit-closing position and to pull free of said gripping means.

18. An alarm switch as set forth in claim 17 wherein said gripping means comprises a spring clip.

19. An alarm switch as set forth in claim 16 having an electrically conductive spring blade mounted at the lower end of the first terminal and extending above said arm, said blade normally being out of contact with said second terminal and being moved into contact with said second terminal by said arm when said arm swings up to its said raised circuit-closing position.

20. An alarm switch unit for actuation by a door comprising:

a support adapted to be mounted above a door opening;

a switch carried by said support, said switch having operating means at the bottom thereof;

an arm mounted at one end thereof on said support extending underneath said switch; said arm being mounted at its said one end for up and down swinging movement toward and away from said switch operating means and also for swinging movement about a generally vertical axis relative to the support, said arm being swingable upwardly to a raised position engaging said switch operating means for closing said switch, and being biased to swing upwardly;

said arm being swingable downwardly against the bias and laterally away from its said raised switch-closing position to an angled position for actuation by the door;

stop means on said support engageable by the arm when swung to its said angled position to hold it down against said bias;

and means at the free end of the arm operable by the door on opening of the door when the arm is in its said angled position for swinging the arm from under said stop means, whereupon the arm swings up to its said raised switch-closing position.

* * * * *